US005641305A

United States Patent [19]

Lutz et al.

[11] Patent Number: 5,641,305

[45] Date of Patent: Jun. 24, 1997

[54] ELECTRICAL DEVICE HAVING ADJUSTABLE CLAMPING MECHANISM

[75] Inventors: David L. Lutz, North Branford; John L. Sandor, Wallingford,, both of Conn.

[73] Assignee: Hubbell Incorporated, Orange, Conn.

[21] Appl. No.: 480,808

[22] Filed: Jun. 7, 1995

[51] Int. Cl.[6] ..... H01R 13/58

[52] U.S. Cl. ..... 439/469

[58] Field of Search ..... 439/469, 813, 439/465, 459, 460, 463, 468

[56] References Cited

U.S. PATENT DOCUMENTS

| | | |
|---|---|---|
| 2,577,748 | 12/1951 | Gillespie . |
| 3,402,382 | 9/1968 | De Tar . |
| 3,437,980 | 4/1969 | Smith . |
| 3,784,961 | 1/1974 | Gartland, Jr. . |
| 3,865,461 | 2/1975 | Ludwig . |
| 4,080,036 | 3/1978 | Hagel . |
| 4,169,572 | 10/1979 | Simon . |
| 4,178,056 | 12/1979 | Lee . |
| 4,213,667 | 7/1980 | Wittes . |
| 4,419,537 | 12/1983 | Leep et al. . |
| 5,021,006 | 6/1991 | Fargeaud et al. . |
| 5,217,389 | 6/1993 | MacKay et al. . |
| 5,354,213 | 10/1994 | Hoffman . |

FOREIGN PATENT DOCUMENTS

| | | |
|---|---|---|
| 497811 | 5/1930 | Germany . |

*Primary Examiner*—Gary F. Paumen
*Assistant Examiner*—Christopher Goins
*Attorney, Agent, or Firm*—Jerry M. Presson; Garrett V. Davis

[57] ABSTRACT

An electrical device in the form of an electrical connector includes a main body having an axial passage for receiving an electrical cord and a fixed jaw extending from the upper face of the main body. A movable jaw is connected to the fixed jaw by a plurality of screws for applying clamping forces to an electrical cord between the jaws. A movable clamping device is carried by either the fixed or movable jaw and is axially and rotationally movable from a first retracted position to an extended position into the passage between the jaw. Movement of the movable clamping device enables the connector to clamp different size electrical cords.

25 Claims, 5 Drawing Sheets

FIG. 9
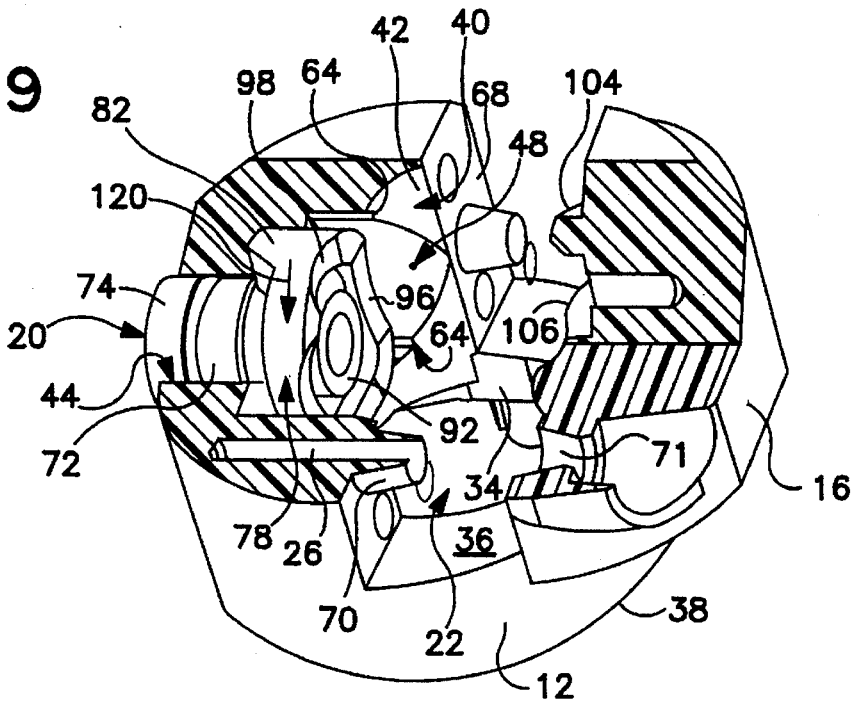
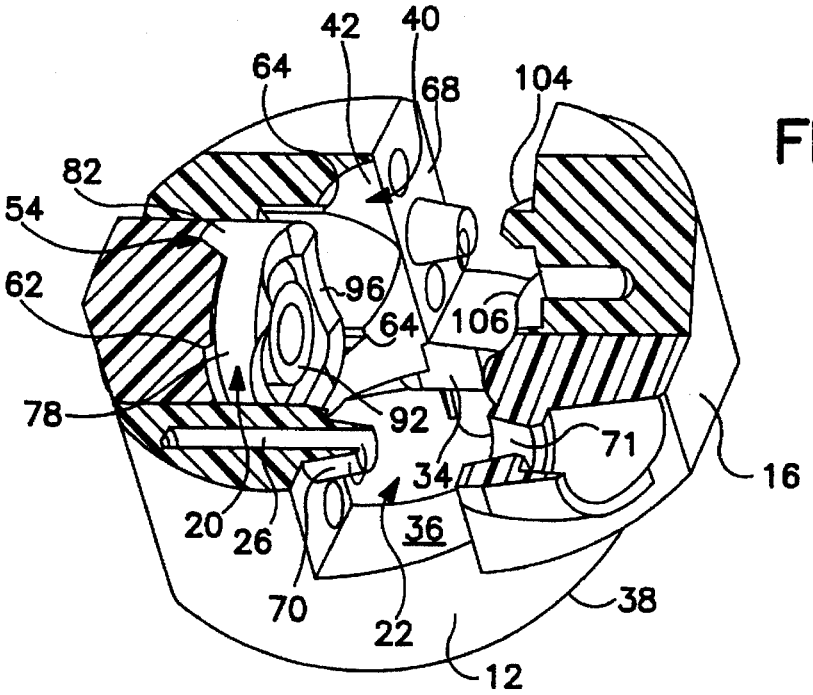
FIG. 10
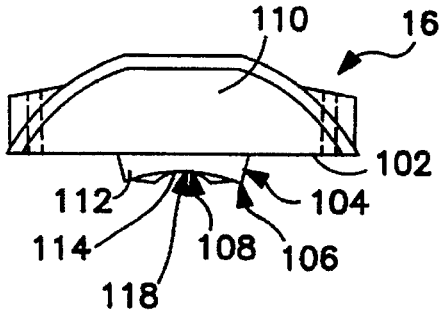
FIG. 11

ELECTRICAL DEVICE HAVING ADJUSTABLE CLAMPING MECHANISM

FIELD OF THE INVENTION

The present invention relates to an electrical device and, in particular, an electrical wire connector which includes a clamping mechanism for coupling electrical cords of varying diameters in the device. More particularly, the invention is directed to an electrical cord clamping mechanism having axial and rotational movement for clamping large of small diameter electrical cords.

BACKGROUND OF THE INVENTION

Electrical devices and connectors typically include a cord clamp for securing the electrical cord in place. One example of a conventional cord clamp includes a pair of clamping jaws where one jaw is movable with respect to the other. A coupling device, such as a screw, extends through the movable jaw and into the other jaw. In this manner, the relative position of the jaws to each other can be adjusted to clamp a cord in place and prevent rotational and axial movement of the cord within the device.

Most electrical devices and cord clamps are manufactured for a single size of electrical cord. However, there are many instances where smaller than standard size cables are desired so that the cord clamping mechanism is not able to effectively grip the cord. Thus, in many instances it is desirable to have an electrical device or connector that is able to accommodate different size electrical cords. Many of the electrical devices currently available are not able to effectively accommodate different size electrical conductors.

One type of device for clamping different sizes of electrical cords includes a fixed clamping jaw and movable clamping jaw biased toward each other where one of the jaws include a recess to receive an insert to reduce the inner dimension of the device. Although this device is able to clamp different sizes of electrical cable, the insert must be removed before clamping a standard size cord. It is generally necessary to disassemble the jaws to be able to remove the insert thereby increasing the time and effort of the user. Failure to remove the inset can result in damage to the electrical cord or connector. An additional disadvantage of the insert is that once removed, the insert is easily lost thereby precluding the subsequent clamping of smaller cords. An example of this type of electrical device is disclosed in U.S. Pat. No. 3,784,961 to Gartland et al.

Examples of other types of cord clamps are disclosed in U.S. Pat. No. 2,577,748 to Gillespie, U.S. Pat. No. 3,402,382 to DeTar, U.S. Pat. No. 3,437,980 to Smith, U.S. Pat. No. 3,865,461 to Ludwig, U.S. Pat. No. 4,080,036 to Hagel, U.S. Pat. No. 4,169,572 to Simon, U.S. Pat. No. 4,178,056 to Lee, U.S. Pat. No. 4,213,667 to Wittes, U.S. Pat. No. 4,419,537 to Leep et al, U.S. Pat. No. 5,021,006 to Fargeaud et al, U.S. Pat. No. 5,354,213 to Hoffman, U.S. Pat. No. 5,217,389 to MacKay et al, and German Patent 497811.

Accordingly, there is a continuing need in the art for a cable clamping mechanism for accommodating different size electrical cables.

SUMMARY OF THE INVENTION

Accordingly, it is a primary object of this invention to provide an electrical device that is able to clamp electrical cords, cables or conduits of different size.

A further object of the invention is to provide an electrical device having a minimal number of moving parts.

Another object of the invention is to provide an electrical device having a projecting clamping member that is axially and rotationally movable from a retracted position for clamping standard size cables to an extended position for clamping small cables.

A further object of the invention is to provide an electrical device that is able to clamp electrical cords, cables or conduits of different size without the use of inserts or removable spacers.

Another object of the invention is to provide an electrical connector that is easily adjustable to accept different size electrical cables.

The foregoing objects are basically attained by providing an electrical wiring device comprising a main body having an outer wall and an inner wall having a first clamping surface; a movable clamping jaw having a second clamping surface opposing the first clamping surface defining an axial passage and being movable with respect to the first clamping surface; the main body having a bore extending radially from the outer wall to the inner wall; movable clamping means, disposed in the bore, for selectively clamping an electrical cable against the second clamping surface; the bore including an axial face facing the axial passage, the axial face including a plurality of first recesses having a first depth and a plurality of second recesses circumferentially spaced from the first recesses and having a second depth, a plurality of projecting keys extending from the clamping means, the projecting keys being received in the first recesses when the clamping means is in a first retracted position and the projecting keys being received in the second recess when the clamping means is in a second position projecting into the axial passage.

The foregoing objects of the invention are further attained by providing an electrical wiring device comprising a main body having an outer wall and an inner wall, the inner wall defining an axial passage for receiving an electrical cord, and having a first clamping surface; a movable clamping jaw having a second clamping surface opposing the first clamping surface and being movable perpendicular to the axial passage; connecting means for connecting the movable clamping jaw to the main body and for applying clamping pressure to an electrical cord passing through the axial passage; the main body having a bore extending radially from said outer wall to the inner wall; clamping means, disposed in the radial bore and being axially and rotationally movable therein from a first retracted position to a second extended position projecting from the clamping face into the axial passage; the clamping means having a first axial face for engaging an electrical cord in the axial passage and a second axial face opposite the first axial face; an annular collar extending radially from the clamping means adjacent the first axial face; at least one projecting key extending axially from the annular collar toward the second axial face; the bore including an axial face spaced from the axial passage, the axial face having at least one first recess for receiving the projecting key when the clamping means is in said first retracted position, and at least one second recess, for receiving the projecting key when the clamping means is in said second extended position with the axial face extending radially into the axial passage; the clamping means and clamping jaw engaging a large diameter cord when the clamping means is in the first retracted position and the clamping means and the clamping jaw engaging a smaller diameter cord when the clamping means is in the second extended position.

Other objects, advantages and salient features of the invention will become apparent from the following detailed description, which, taken in connection with the annexed drawings, discloses preferred embodiments of the invention.

BRIEF DESCRIPTION OF THE DRAWINGS

Referring to the drawings which form a part of this original disclosure in which:

FIG. 9 is an exploded perspective view in partial cross section of the electrical device showing the movable clamping device in the retracted position;

FIG. 10 is an exploded perspective view in partial cross-section of the electrical device showing the movable clamping device in the retracted position; and FIG. 11 is a top plan view of the movable clamping jaw.

DETAILED DESCRIPTION OF THE INVENTION

Figure 1:
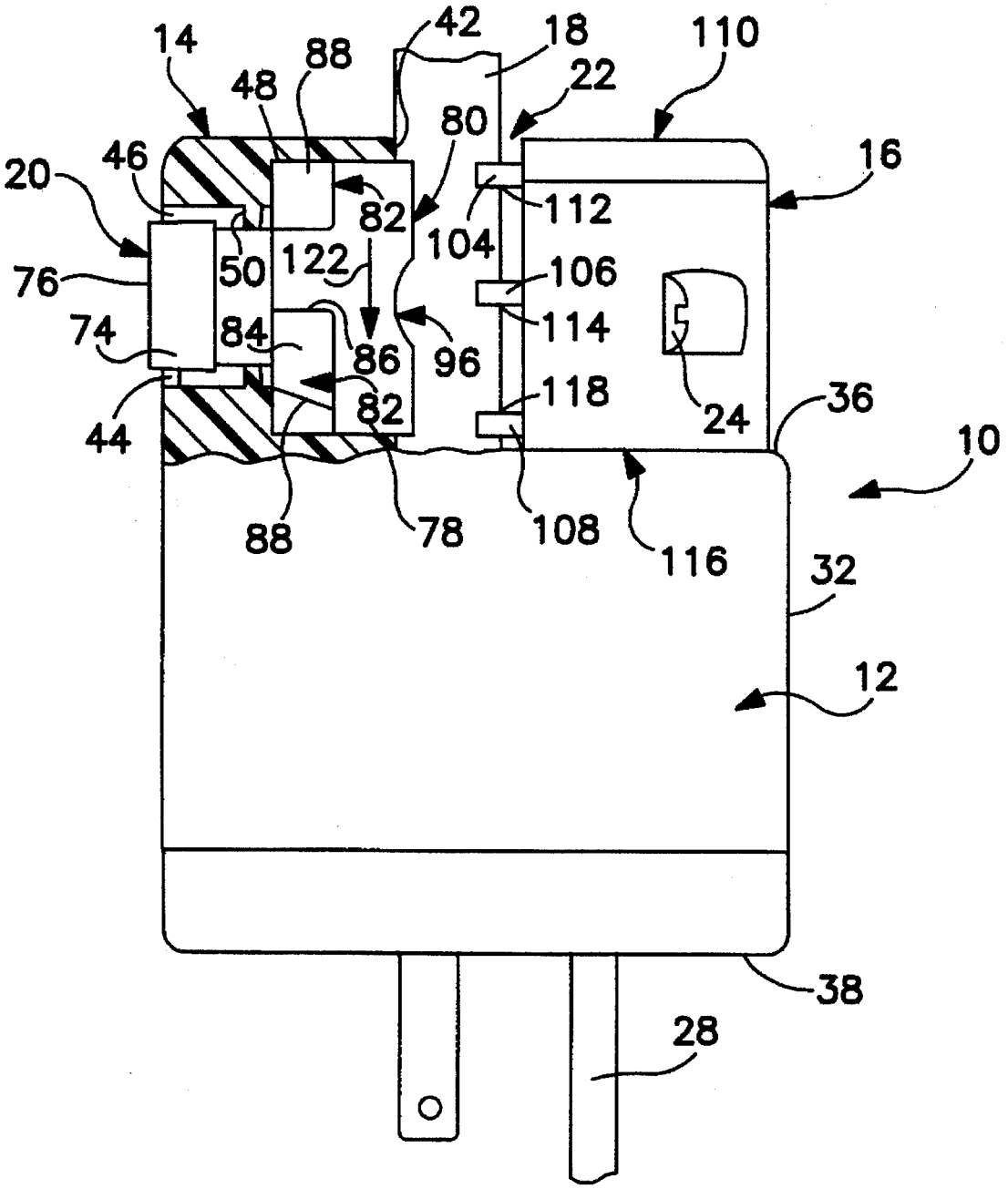
FIG. 1 is a side elevational view of the electrical device in partial cross-section showing the adjustable cable clamp in the retracted position clamping a standard diameter cable.

The present invention is directed to an electrical device for accommodating different sizes of electrical cords, cables or conduits. Referring to FIGS. 1–10, the electrical device in accordance with the invention is an electrical connector 10 comprising a main body 12 having a first fixed clamping jaw. 14, a second movable clamping jaw 16 for clamping an electrical cord 18, and a movable clamping device 20. Movable clamping device 20 is mounted for axial and rotational movement into and out of an axial passage 22 extending axially between first and second clamping jaws 14 and 16 and through main body 12. Clamping jaws 14 and 16 are connected together by a pair of screws 24 extending through movable clamping jaw 16 and into threaded holes 26 in fixed clamping jaw 14. Screws 24 bias movable clamping jaw 16 toward fixed clamping jaw 14 and applies clamping or gripping pressure to electrical cord 18 between the clamping jaws 14, 16 with the cord extending through the axial passage 22.

Electrical connector 10 is illustrated as being attached to a bottom male electrical connector including electrical blades or prongs 28 which is connected to a female receptacle by inserting the prongs into the receptacle in the conventional manner. In alternative embodiments, the electrical connector 10 can be attached to a female receptacle or a coupling for providing electrical connection between two electrical cords. In preferred embodiments, main body 12, clamping jaws 16 and 18, and movable clamping device 20 are made from an insulating plastic material.

Electrical cord 18 includes an outer insulating sheath or covering which encloses at least one and preferably a plurality of smaller insulated electrical conductors. The insulated conductors have exposed ends for electrical connection with prongs 28 in a conventional manner. The outer sheath of insulation on the cord is generally sufficiently flexible to allow gripping by clamping jaws 14 and 16.

Main body 12 comprises a substantially cylindrical outer wall 32 and an inner wall 34 defining axial passage 22. Main body 12 includes an upper surface 36 where electrical cord enters axial passage 22 and a lower surface 38.

Figure 2:
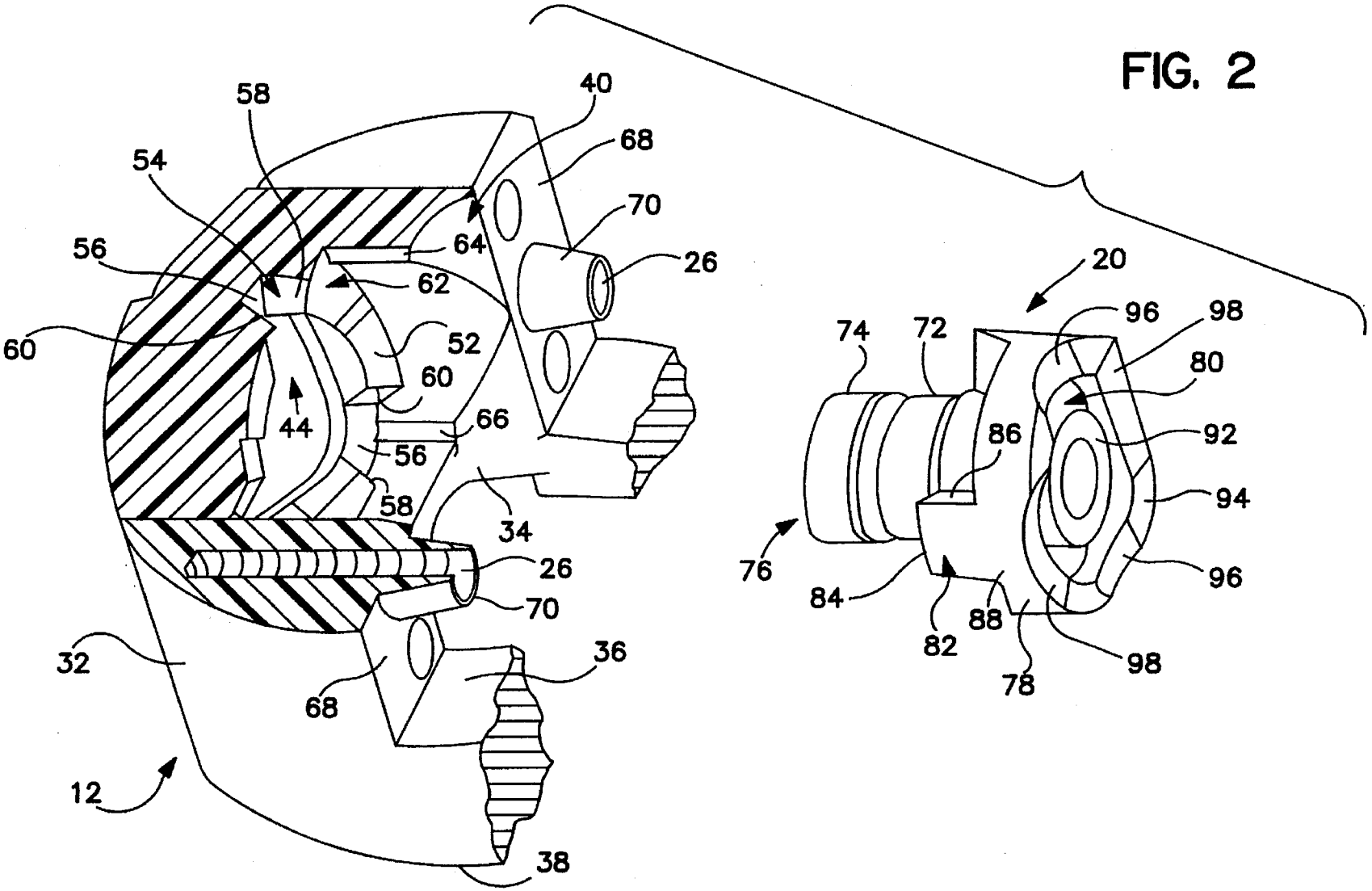
FIG. 2 is an exploded perspective view in partial cross-section of the electrical device and projecting cable clamp showing the fixed clamping jaw and the movable clamping device.

Fixed clamping jaw 14 is integrally formed with main body 12 and extends upwardly from upper surface 36 as shown in FIGS. 1 and 2. The contoured inner wall 40 of fixed clamping jaw 14 is a continuation of inner wall 34 which defines axial passage 22. In the embodiment shown, inner wall 40 has a semi-circular shape defining clamping surfaces 42 facing axial passage 22.

Fixed clamping jaw 14 includes a bore 44 extending radially therethrough from the outer wall 46 to inner wall 40. Radial bore 44 is defined by a first portion 46 adjacent the outer wall of fixed clamping jaw 14 and an inner portion 48 adjacent inner wall 40. An annular rib 50 positioned midway between inner wall 40 and the outer wall extends radially inward to define a stop member for limiting axial movement of movable clamping device 20 as discussed hereinafter in greater detail. As shown in FIGS. 1 and 2, second portion 48 of radial bore 44 has a diameter greater than first portion 46 and is separated by an axial face 52 facing inwardly toward axial passage 22. A plurality of first recesses 54 are formed in axial face 52 having a first depth. First recesses 54 include a bottom surface 56, a first side wall 58 extending axially with respect to the axis of radial bore 44 and an inclined side wall 60.

Axial face 52 also includes a plurality of second recesses 62 circumferentially spaced from first recesses 54 and having a second depth. As shown in FIG. 2, the depth of second recesses 62 is less than the depth of first recesses 54. In the embodiment shown, radial bore 44 includes three uniformly spaced-apart first recesses 54 and three uniformly spaced-apart second recesses 62. In preferred embodiments, second recesses 62 are adjacent straight side wall 58 of first recesses 54.

Figure 4:
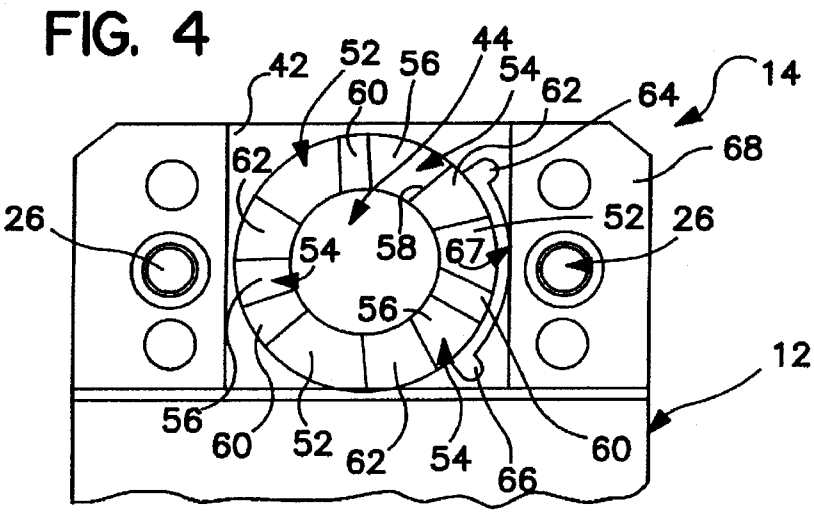
FIG. 4 is a front side elevational view of the electrical device showing a radial bore and recesses therein with the movable clamping device removed.
Figure 6:
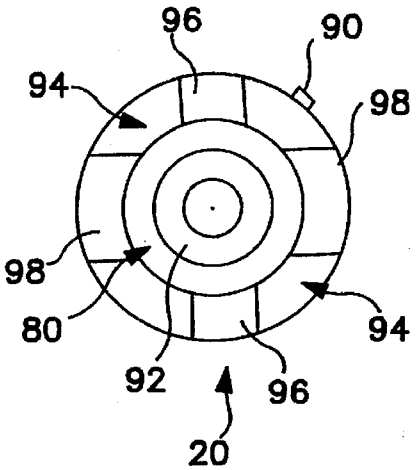
FIG. 6 is an end elevational view of the movable clamping device showing the clamping face.
Figure 5:
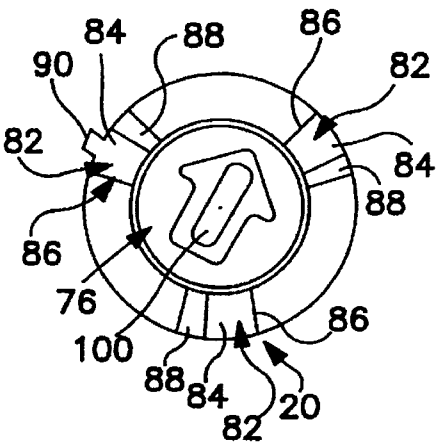
FIG. 5 is an end elevational view of the movable clamping device showing the slot for receiving a tool.

First portion 56 of radial bore 44 also includes two radially spaced-apart detents 64 and 66. Detent 64 is formed as a groove extending axially from the bottom surface of one of the second recesses 62 toward the upper edge of fixed clamping jaw 14 and extends axially with respect to inner wall 40 and axial passage 22. Detent 66 is also formed as a groove extending from bottom wall 56 of first recess 54 and extends axially therefrom with respect to inner wall 40 toward the upper edge of fixed clamping jaw 14. As shown in FIG. 4, inner portion 48 of radial bore 44 includes an arcuate recessed area 67 extending between detents 64 and 66.

Fixed clamping jaw 14 includes a planar face 68 for opposing and mating with movable clamping jaw 16. Threaded holes 26 extend into planar face 68 on each side of inner wall 40. Frustoconical-shaped elements 70 surround threaded holes 26 for aligning with complementary shaped recesses 71 in movable clamping jaw 14.

Movable clamping device 20 includes a substantially cylindrical body portion 72 having an annular stop member 74 adjacent outer axial face 76. An annular collar 78 adjacent inner axial face 80 extends radially outward from body portion 72. A plurality of projecting keys 82 extend from annular collar 78 in the axial direction toward outer axial face 76. Projecting keys 82 include a flat end face 84, a straight side wall 86 and an inclined side wall 88. In the embodiment illustrated, three projecting keys 82 are uniformly spaced apart on annular collar 78 to complement the first recesses 54 in axial face 52 of radial bore 44. Preferably, projecting keys 82 are substantially the same size as first recesses 54 to mate therewith. One of the projecting keys 82 includes a projecting stop member 90 extending radially outward therefrom for mating with detents 64 and 66 and slides in recess 67 between the detents to limit the extent of rotation of movable clamping device 20.

Inner axial face 80 of movable clamping device 20 includes an inner annular ridge 92 for engaging the electrical cord 18. Annular collar 78 also includes an outer annular ridge 94 extending from inner axial face 80 and being concentric with inner annular ridge 92. Outer annular ridge 94 includes a first pair of arcuate recesses 96 spaced 180° apart. Recesses 96 have a radius of curvature to complement a small diameter electrical cord. A second pair of arcuate recesses 98 spaced 90° from first arcuate recesses 96 are also provided on outer annular ridge 94. Arcuate recesses 98 have a radius of curvature for complementing a large electrical cord such that the depth of arcuate recess 98 is greater than the depth of arcuate recess 96. Outer axial face 76 of movable clamping device 20 includes a slot 100 for receiving a tool, such as a screwdriver, for rotating movable clamping device 20 within radial bore 44 from a first position where stop member 90 is received in detent 66 to a second position where stop member 90 is received in detent 64.

Movable clamping jaw 16 is separable from main body 12 and is movable in a radial direction with respect to axial passage 22 by threaded screws 24. Movable clamping jaw 16 includes a substantially planar face 102 which cooperates with inner wall 40 of fixed clamping jaw 14, and conical recesses 71 for seating frustoconical elements 70. Movable clamping jaw 16 provides axial passage 22 with a variable size for receiving different size electrical cords 18.

In the embodiment shown in FIG. 11, planar face 102 includes three gripping ribs 104, 106 and 108 for gripping electrical cord 18. First gripping rib 104 is positioned adjacent the upper face 110 of movable clamping jaw 20 and includes an arcuate surface 112 having a large radius for complementing a large diameter electrical cord. Second gripping rib 106 is spaced from first gripping rib 104 and parallel thereto includes an arcuate face 114. Arcuate face 114 has a radius slightly less than the radius of arcuate surface 112 for complementing a slightly smaller electrical cord. Gripping rib 108 is positioned adjacent lower face 116 of movable clamping device 20 and includes an arcuate face 118. Arcuate face 118 has a radius substantially the same as arcuate face 112. As shown in FIG. 11, arcuate faces 112, 114 and 118 are spaced from face 102 the same distance. In this manner, movable clamping jaw 20 is able to effectively grip electrical cords of different diameters.

Electrical connector 10 is assembled by inserting movable clamping device into radial bore 44 of first clamping jaw 14. Movable clamping jaw 20 is pressed into position in radial bore 44 from inner wall 40 and is pressed into place until stop member 74 snaps over stop member 50. Movable clamping device 20 is positioned such that stop member 90 on projecting key 82 is positioned in detent 66 and projecting keys 82 are seated in recesses 54 such that movable clamping device 20 is in a fully retracted position with annular collar 78 contacting axial face 52 of radial bore 44. When movable clamping device 20 is in the retracted position, large arcuate recesses 98 on annular ridge 94 are axially aligned with axial passage 22. Movable clamping jaw 16 is then coupled to first clamping jaw 14 by inserting screws 24 through the holes in the jaws. An electrical cord 18 is passed through axial passage 22 to make the appropriate electrical connections with prongs 28. Screws 24 are then tightened to apply clamping forces between movable jaw 16 and fixed clamping jaw 14. Electrical cord 18 is clamped between arcuate recesses 98, inner annular ridge 92 on axial face 80 and gripping ribs 104, 106 and 108 on movable clamping jaw 14.

Figure 3:
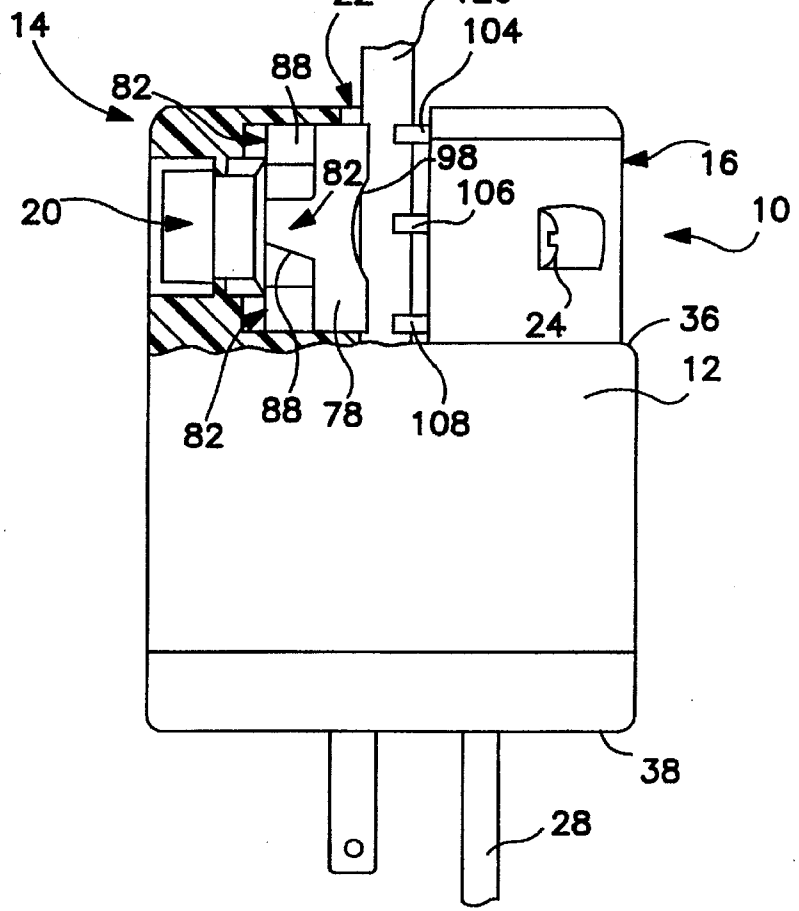
FIG. 3 is a side elevational view in partial cross-section of the electrical device showing the clamping device in the extended position clamping a small diameter cable.
Figure 7:
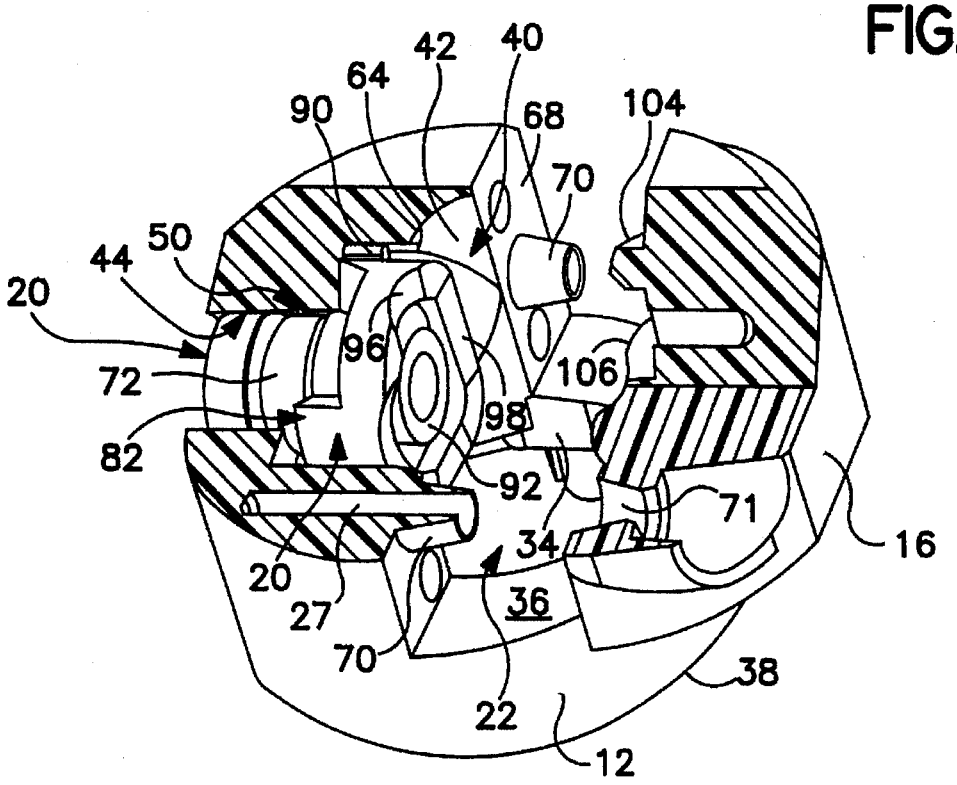
FIG. 7 is an exploded perspective view in partial cross-section of the electrical device showing the movable clamping device in the extended position.
Figure 8:
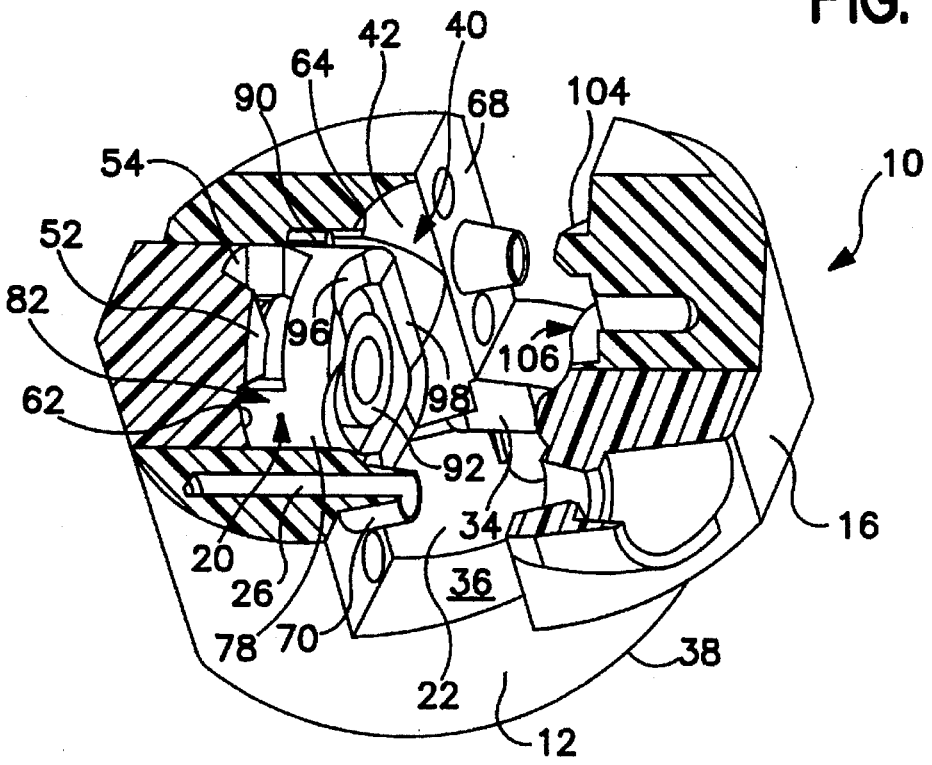
FIG. 8 is an exploded perspective view in partial cross-section of the electrical device showing the movable clamping device in the extended position.

A standard size electrical cord 18 is positioned in electrical connector 10 which substantially fills the axial passage 22 as shown in FIG. 1. Annular ridges 92 and 94 on movable clamping device 20, first clamping surface 40, and gripping ribs 104, 106 and 108 engage electrical cord 18 and form an impression in the outer casing by clamping pressure. Electrical connector 10 is adapted for receiving and effectively gripping an electrical cord having a smaller outer diameter than a standard size electrical cord. To accommodate a smaller size electrical cord 120 as shown in FIG. 3, movable clamping device 20 is rotated 90° until stop member 90 on projecting key 82 engages detent 64. Stop member 90 frictionally engages arcuate recess 67 during rotational movement of movable clamping device 20. Stop member 90 snaps into detents 64 and 66 to maintain movable clamping member 20 in the selected position. As movable clamping device 20 is rotated, inclined side wall 88 of projecting key 82 engages inclined wall 60 of recess 54 to provide a camming action which urges movable clamping device 20 axially and rotationally toward axial passage 22. Stop member 50 in radial bore 44 engages stop member 74 of body portion 72 to limit the inward axial movement of movable clamping device 20.

As shown in FIG. 9, projecting key 82 of movable clamping device 20 in a first position is initially seated in recess 54. Rotating movable clamping device 20 in the direction of arrow 120 cams projecting key 82 axially up inclined wall 60. End face 84 of projecting key 82 then slides along axial face 52 of radial bore 44 until projecting key 84 seats into recess 62. Recess 62 is shallow in comparison to recess 54, but is sufficiently deep to positively engage projecting key 82 to resist rotational movement. Stop member 90 is able to slide along arcuate recess 67 as movable clamping device 20 moves axially and rotationally. When movable clamping jaw 20 is in the second position shown in FIG. 8, arcuate recesses 96 on outer annular ridge 94 are axially aligned with axial passage 22. As shown in FIG. 3, the extended position of movable clamping device 20 reduces the dimension of axial passage 22. Electrical cord 120 is passed through axial passage 22 and screws 24 are tightened to apply clamping forces to movable clamping jaw 16 in the manner discussed above.

Detents 64 and 66 and stop member 90 are positioned to allow movable clamping device 20 to rotate about 90° to selectively align either recess 96 or recess 98 with axial passage 22 and to project axial face 80 into axial passage 22. As seen in FIG. 2, each first recess 54 has a cooperating second recess 62 at the rotational limits of movable clamping member 20. Although the cooperating second shallow recesses 62 are adjacent a deeper first recess 54, projecting key 82 is prevented from rotating past shallow recess 62 into the adjacent recess 62 by stop member 90 snapping into detent 62.

While advantageous embodiments have been chosen to illustrate the invention, it will be understood by those skilled in the art that various changes and modifications can be made therein without departing from the scope of the invention as defined in the appended claims.

What is claimed is:

1. An electrical wiring device comprising:

a main body having an outer wall and an inner wall having a first clamping surface;

a movable clamping jaw having a second clamping surface opposing said first clamping surface defining an axial passage and being movable with respect to said first clamping surface;

said main body having a bore extending radially from said outer wall to said inner wall;

movable clamping means, disposed in said bore, for selectively clamping an electrical cable against said second clamping surface;

said bore including an axial face facing said axial passage, said axial face including a plurality of first recesses having a first depth and a plurality of second recesses circumferentially spaced from said first recesses and having a second depth less than said first depth, a plurality of projecting keys extending from said movable clamping means, said projecting keys being received in said first recesses when said movable clamping means is in a first retracted position and said projecting keys being received in said second recess when said movable clamping means is in a second position projecting into said axial passage.

2. The clamp of claim 1, wherein said movable clamping means includes a first axial face facing said axial passage, a second axial face opposite said first axial face, and an annular collar extending radially outward adjacent said first axial face.

3. The device of claim 1, wherein said bore includes a first portion adjacent said axial passage dimensioned for receiving said annular collar, and a second portion dimensioned for receiving said clamping means, said first and second portions being separated by said axial face of said bore.

4. The device of claim 3, wherein said at least one first recess has a depth to receive said projecting key so that said annular collar engages said axial face when said movable clamping means is in said retracted position.

5. The device of claim 4, wherein said at least one second recess has a depth to receive said projecting key so that said annular collar is spaced from said axial face of said bore when said movable clamping means is in said second extended position.

6. The device of claim 5, wherein said first recess in said axial face is circumferentially spaced from said second recess.

7. The device of claim 1, wherein said projecting key includes an inclined camming surface and said first recess includes an inclined surface for mating with said camming surface.

8. The device of claim 2, wherein said annular collar includes a projecting stop member, and said bore includes an arcuate recess for receiving said stop member and for providing limited rotational and axial movement of said movable clamping means in said bore.

9. The device of claim 8, wherein said arcuate recess includes a detent at opposite ends thereof for receiving said stop member in a snap fit relationship when said clamping means is in said first and second positions.

10. The device of claim 2, wherein said annular collar includes a first annular ridge extending axially from said axial face.

11. The device of claim 1, wherein said annular ridge includes a first pair of arcuate recesses disposed on opposite sides of said annular ridge and having a first radius for engaging a first cord when said movable clamping means is in said first retracted position, and a second pair of arcuate recesses disposed on opposite sides of said annular ridge radially spaced from said first arcuate recesses and having a second radius for engaging a second cord when said movable clamping means is in said second extended position.

12. The device of claim 1, wherein said clamping means comprises three radially spaced-apart projecting keys, and said bore includes three radially spaced-apart first and second recesses for receiving said projecting keys.

13. The device of claim 1, wherein said second axial face of said clamping means includes a slot for receiving a tool.

14. The device of claim 10, wherein said movable clamping means comprises a second annular ridge extending axially from said first axial face for engaging a cable, said second annular ridge being spaced inwardly from and concentric to said first annular ridge.

15. The device of claim 1, wherein said movable clamping jaw includes a plurality of ribs for engaging an electrical cable, each of said ribs include an arcuate face, and wherein each of said arcuate faces have a different radius for gripping different size electrical cables.

16. An electrical cord clamp comprising:

a main body having an outer wall and an inner wall, said inner wall defining an axial passage for receiving an electrical cord, and having a first clamping surface;

a movable clamping jaw having a second clamping surface opposing said first clamping surface and being movable perpendicular to said axial passage;

connecting means for connecting said movable clamping jaw to said main body and for applying clamping pressure to an electrical cord passing through said axial passage;

said main body having a bore extending radially from said outer wall to said inner wall;

clamping means, disposed in said radial bore and being axially and rotationally movable therein from a first retracted position to a second extended position projecting from said clamping face into said axial passage;

said clamping means having a first axial face for engaging a cord in said axial passage and a second axial face opposite said first axial face;

an annular collar extending radially from said clamping means adjacent said first axial face;

at least one projecting key extending axially from said annular collar toward said second axial face;

said bore including an axial face spaced from said axial passage, said axial face having a plurality of first recesses in said axial face for receiving said projecting key when said clamping means is in said first retracted position, and a plurality of second recesses in said axial face circumferentially spaced from said first recesses, for receiving said projecting key when said clamping means is in said second extended position with said first axial face extending radially into said axial passage;

said clamping means and second clamping surface engaging a large diameter cord when said clamping means is in said first retracted position and said clamping means and said clamping jaw engaging a smaller diameter cord when said clamping means is in said second extended position.

17. The clamp of claim 16, wherein said bore has a first portion adjacent said axial passage dimensioned for receiving said annular collar, and a second portion dimensioned for receiving said clamping means, said first and second portions being separated by said axial face.

18. The clamp of claim 16, wherein said at least one first recess has a depth to receive said projecting key so that said annular collar engages said axial face of said bore, and said second recesses being circumferentially spaced from said first recess and having a depth to receive said projecting key so that said annular collar is spaced from said axial face of said bore.

19. The clamp of claim 16, wherein said projecting key includes an inclined camming surface and said first recess includes an inclined surface for mating with said camming surface.

20. The clamp of claim 16, wherein said annular collar includes a projecting stop member, and said bore includes an arcuate recess for receiving said stop member and for providing limited axial movement of said clamping means in said bore.

21. The clamp of claim 20, wherein said arcuate recess includes a detent at opposite ends thereof for receiving said stop member in a snap fit relationship when said clamping means is in said first and second position.

22. An electrical cord clamp comprising:

a main body having an outer wall and an inner wall, said inner wall defining an axial passage for receiving an electrical cord, and having a first clamping surface;

a movable clamping jaw having a second clamping surface opposing said first clamping surface and being movable perpendicular to said axial passage;

connecting means for connecting said movable clamping jaw to said main body and for applying clamping pressure to an electrical cord passing through said axial passage;

said main body having a bore extending radially from said outer wall to said inner wall;

clamping means, disposed in said radial bore and being axially and rotationally movable therein from a first retracted position to a second extended position projecting from said clamping face into said axial passage;

said clamping means having a first axial face for engaging a cord in said axial passage and a second axial face opposite said first axial face;

an annular collar extending radially from said clamping means adjacent said first axial face;

said annular collar including a first annular ridge extending axially from said axial face, said annular ridge including a first pair of arcuate recesses disposed on opposite sides of said annular ridge and having a first radius of curvature for engaging a first electrical cord when said clamping means is in said first position, and a second pair of arcuate recesses disposed on opposite sides of said first annular ridge and having a second radius of curvature for engaging a second cord when said clamping means is in said second position;

at least one projecting key extending axially from said annular collar toward said second axial face;

said bore including an axial face spaced from said axial passage, said axial face having at least one first recess for receiving said projecting key when said clamping means is in said first retracted position, and at least one second recess, for receiving said projecting key when said clamping means is in said second extended position with said axial face extending radially into said axial passage;

said clamping means and second clamping surface engaging a large diameter cord when said clamping means is in said first retracted position and said clamping means and said clamping jaw engaging a smaller diameter cord when said clamping means is in said second extended position.

23. The clamp of claim 16, wherein said clamping means comprises three radially spaced-apart projecting keys, and said bore includes three radially spaced-apart first and second recesses for receiving said projecting keys.

24. The clamp of claim 16, wherein said second axial face of said clamping means includes a slot for receiving a tool.

25. The clamp of claim 22, wherein said clamping means comprises a second annular ridge extending axially from said first axial face for engaging a cable, said second annular ridge being spaced inwardly from and concentric to said first annular ridge.

* * * * *